United States Patent [19]

Hogle

[11] Patent Number: 4,785,934

[45] Date of Patent: Nov. 22, 1988

[54] ARROW FLETCH COVER

[76] Inventor: Hugh H. Hogle, 1627 Wasatch, Salt Lake City, Utah 84108

[21] Appl. No.: 151,236

[22] Filed: Feb. 1, 1988

[51] Int. Cl.[4] ..... B65D 85/20

[52] U.S. Cl. ..... 206/315.11; 383/66; 383/67; 383/21; 383/25; 150/52 R; 224/916

[58] Field of Search ..... 224/916; 206/315.11; 383/66, 67, 21, 25; 150/52 H, 52 R

[56] References Cited

U.S. PATENT DOCUMENTS

| | | | |
|---|---|---|---|
| 2,963,731 | 12/1960 | Hoots | 150/52 R |
| 3,380,504 | 4/1968 | Green | 150/52 R |
| 3,766,954 | 10/1973 | Gentellalli | 150/52 R |

*Primary Examiner*—William Price

*Attorney, Agent, or Firm*—B. Deon Criddle

[57] ABSTRACT

An arrow fletch covering comprising a sheath having one closed end and one elasticized open end and adapted to fit over the fletched end of an arrow. A release string is attached to the closed end, and a side opening may be provided to permit installation over feathered fletches.

3 Claims, 1 Drawing Sheet

ARROW FLETCH COVER

BACKGROUND OF THE INVENTION

1. Field of the Invention

The present invention relates to the field of archery and is particularly concerned with covers to be provided for the fletched ends of arrows so that the fletching is protected and the brilliance of the fletchings are covered in a quiver.

2. Prior Art

While bonnet-type covers have been known for use over arrows contained in a quiver, I am not aware of any sheaths or individual covering for the fletching of arrows.

BACKGROUND OF THE INVENTION

It has long been common for archery enthusiasts to carry quivers full of arrows to be used in bow hunting. The value of bright, even fluorescent, fletchings on arrow shafts has also long been recognized. Bright colors enable the user to more easily track the flight of an arrow and then to follow the path of an animal struck by such arrow. However, it is believed that the brightly colored fletchings, particularly when congregated in a quiver provide a bright surface that may be easily observed by an animal being hunted and that will then alarm and frighten the animal away.

OBJECT OF THE INVENTION

A principal object of the present invention is to provide a cover that can be applied to an individual arrow and that will effectively cover the fletching on the arrow.

Another object is to provide such a cover that is quickly and easily removed from an individual arrow in the midst of a collection of arrows in a quiver even as the arrow remains in the quiver and with the arrow then being separately removed from the quiver.

Still other objects are to provide cover that will not damage the fletching as it is positioned on the arrow or removed from the arrow.

FEATURES OF THE INVENTION

Principal features of the invention include a flexible fabric generally tubular, sheath having one closed end and one open elasticized end. A same-rigid release string is fixed to and extends upwardly from the closed end of the sheath. In one embodiment a side opening may be provided from the elasticized end to adjacent the closed end to facilitate placement of the sheath over feathered fletching on an arrow shaft.

Other objects and features of the invention will become apparent to those skilled in the art to which the invention pertains from the following detailed description and drawing, disclosing what is presently contemplated as being the best mode of the invention.

THE DRAWING

In the drawing:

FIG. 1 is a perspective view of the sheath of the invention;

FIG. 2, a sectional view taken on line 2—2 of FIG. 1;

FIG. 3, a sectional view taken on line 3—3 of FIG. 1;

FIG. 4, a sectional view taken on line 4—4 of FIG. 1; and

FIG. 5, a view like that of FIG. 1, but showing a second embodiment of sheath.

DETAILED DESCRIPTION

Figure 1:
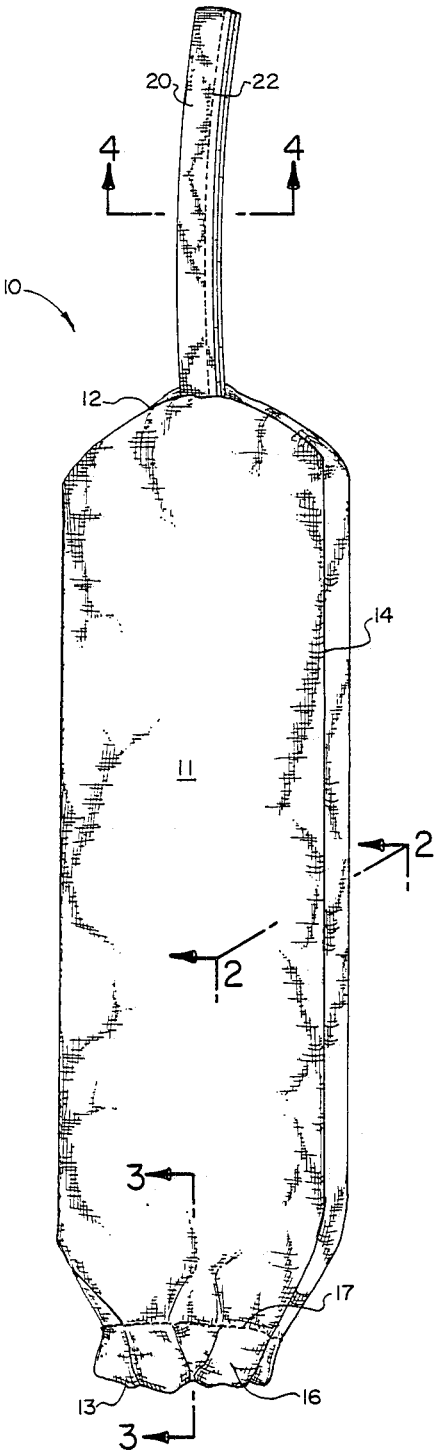
Figure 2:
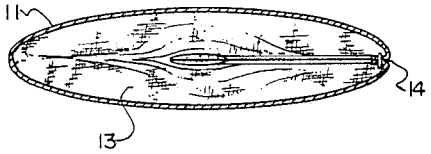
Figure 3:
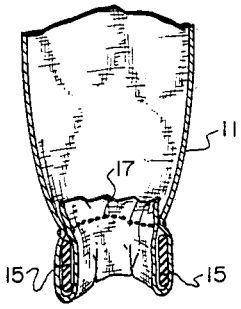
Figure 4:
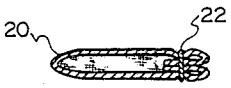

Referring now to the drawing:

In the illustrated preferred embodiment of the invention the arrow fletch cover is shown generally at 10 in FIG. 1. As shown, the fletch covering includes a generally tubular sheath 11 having a closed end 12 in an open elasticized end 13. The sheath is formed by doubling back a piece of flexible sheet material and sewing it along engaging surfaces as shown at seam 14. A ring of elastic material 15 is sewn into an inturned edge 16, as shown at 17, to provide an elasticized, gathered, opening at one end of the sheath 11.

A semi-rigid release string 20, which may be made from a number of thicknesses of the same fabric from which sheath 11 is made, folded back and in, and then sewn along seam 22, is attached to closed end 12 of sheath 11 and projects outwardly from the sheath. The semi-rigid construction allows the strings to stand and project from the sheath.

In use, the arrow fletch cover 10 is positioned downwardly over the fletched end of an arrow by first stretching the end 13 to allow it to clear the fletching. The sheath 11 is slipped axially down the arrow shaft and over the fletching and the end 13 compresses around the arrow shaft.

If a user desiring to remove the arrow fletch cover 10 from the arrow it is a simple matter to grasp the upstanding release string 20 and to pull the cover 10 axially from the fletching end of the arrow. With the plastic fletchings commonly used today, there is no damage to the fletchings either when the sheath 11 is slipped over the end of the arrow or when the sheath is pulled from the arrow.

For arrows that use feathered fletchings, it has been found desirable to provide a side opening in the sheath 11 so that the cover 10 can be installed sideways or transversely to the shaft axis onto the arrow shaft.

Figure 5:
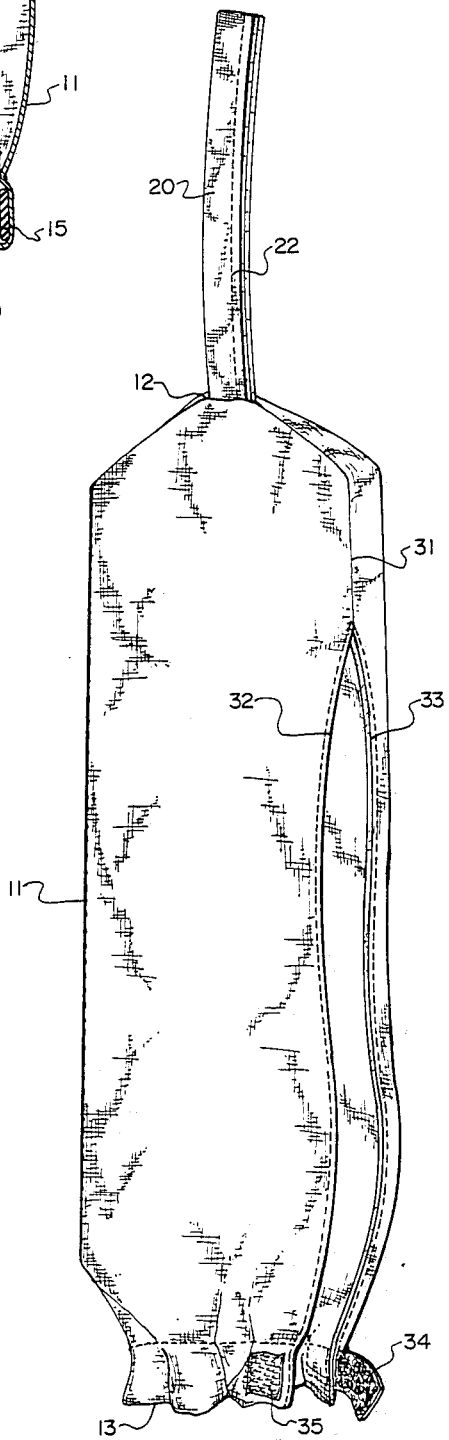

An embodiment of the arrow fletch cover having a side opening is shown at 30, in FIG. 5.

In the embodiment of FIG. 5, the arrow fletch cover includes the same folded back, flexible sheet material forming a sheath 11. The sheath 11 has a closed end 12, and an upstanding semi-rigid release string 20, all as previously described. In the embodiment of FIG. 5, the sheath material 11 is folded back and the mating edges are sewn together as previously described at 31. However, the mating edges from the elasticized end 13 to a point adjacent the closed end 12 are individually hemmed, as shown at 32 and 33, respectively. The elasticized end 13 is provided with a ring of elastic material, in the same manner previously described, but the ring is cut to allow the end 13 to open. A pair of interacting locking members are provided at opposite sides of the opening, at the elasticized ring, to allow the separated side walls of sheath 11 to be interconnected. As shown, the locking members comprises a hooked member 34 and a napped member 35 that will interlock. Such locking members are well known under the trademark "Velcro".

In use, the embodiment of the invention of FIG. 5 is used in substantially the same manner as is the embodiment previously described. However, with the interlocking members 34 and 35, released, the entire side of the sheath 11 is open to allow it to be installed sideways or transversely to the axis of the shaft onto an arrow shaft and to cover the fletching on the shaft. Thereafter, the members 34 and 35 are interlocked and the sheath is ready to be withdrawn by pulling on release string 20, in the manner previously described. Axial removal of cover 30 does not injure feather fletching since it is pulled in the direction in which the feathers are angled.

With either of the embodiments of arrow fletch cover shown, the fabric 11 can be made in any desired color. Thus, it may be made green, or brown, to correspond to foliage, or it may be given a camouflaged effect, incorporating a number of colors. The material from which the cover is made need only be a flexible sheet material of desired color and characteristics. A waterproof material may be used, particularly with covers to be used for feathered fletching. In any event, the sheath covers the fletching end of the arrow and allows the user to have an arrow with bright colored fletching, but with the color protected against visibility to animals being hunted.

Although preferred forms of my invention have been herein disclosed, it is to be understood that the present disclosure is by way of example and that variations are possible without departing from the subject matter coming within the scope of the following claims, which subject matter I regard as my invention.

I claim:

1. An arrow fletch cover for fletched ends of arrows, comprising a generally tubular sheath, having one closed end and one elasticized open end; and a semi-rigid release string having one end fixed to the closed end of the sheath and projecting upwardly and projecting from said closed end.

2. An arrow fletch cover as in claim 1, wherein the tubular sheath is made from a single piece of flexible fabric material folded and having the mating edges thereof sewn together.

3. An arrow fletch sheath as in claim 1, further including means forming an opening up the side wall of the substantially tubular sheath; and locking means for releasably interconnecting the separated portions of the elasticized end of the sheath.

* * * * *